US006619826B1

(12) United States Patent
Redzinsky et al.

(10) Patent No.: US 6,619,826 B1
(45) Date of Patent: Sep. 16, 2003

(54) HEADLIGHT DEVICE FOR VEHICLE

(75) Inventors: Kirsten Redzinsky, Pfullingen (DE); Erwin Wittmeier, Gomaringen (DE); Heinz Grimm, Pfullingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/510,455

(22) Filed: Feb. 22, 2000

(30) Foreign Application Priority Data

Feb. 26, 1999 (DE) ..... 199 08 480

(51) Int. Cl.[7] ..... F21V 17/02
(52) U.S. Cl. ..... 362/512; 362/520; 362/523
(58) Field of Search ..... 362/512, 520, 362/514, 521, 523, 524, 532, 539, 351, 339

(56) References Cited

U.S. PATENT DOCUMENTS 5,440,456 A * 8/1995 Bertling et al. ..... 362/520
5,673,990 A * 10/1997 Neumann et al. ..... 362/513

FOREIGN PATENT DOCUMENTS

DE 44 07 108 A1 1/1995

* cited by examiner

*Primary Examiner*—Sandra O'Shea
*Assistant Examiner*—Guiyoung Lee
(74) *Attorney, Agent, or Firm*—Michael J. Striker

(57) ABSTRACT

A headlight device for motor vehicles has a light source for emitting light beams, a reflector for reflecting at least a part of the light beams emitted by the light source in a light outlet direction on a region in front of the vehicle, and a dispersing element which is bringable in beam path of the light beams reflected by the reflector.

18 Claims, 2 Drawing Sheets

HEADLIGHT DEVICE FOR VEHICLE

BACKGROUND OF THE INVENTION

The present invention relates to a headlight device for vehicle, in particular for a motor vehicle.

More particularly it relates to a headlight device which has a light source for emitting light beams and reflector for reflecting at least a part of light beams emitted by the light source in a light outlet direction onto a region in front of the vehicle.

Such headlight devices are known in different embodiments from the prior art. When the headlight device is turned on, the light source emits the light beams. At least a part of the light beams falls on the reflector and is deviated by it in the light outlet direction onto a region in front of the vehicle. The light distribution in the region in front of the vehicle can be varied approximately arbitrarily by different features. These features include for example a different shape of the reflector (for example ellipsoidal), paraboloidal or polyllipsoidal shape) and the introduction of a screen in the path of the light beams, including a different design of the screen shape, in particular the screen upper edge, for producing any bright-dark transition in the region in front of the vehicle. As a further feature it is known to arrange a lens in the path of the light beams for bundling of the light beams and deviating to the region in front of the vehicle. This feature is used in the prior art for influencing the light distribution of the low beam or high beam. For influencing the light distribution of a fog light, it is known to arrange in the path of the light beams a dispersing element, as a rule a dispersing-disk.

By selection of a predetermined light source, moreover the light stream of the headlight device and thereby the brightness in the region in front of the vehicle can be influenced. With the use of a gas discharge lamp, in particular xenon lamp as a light source, the light stream with regard to conventional halogen lamps can be increased approximately two or three times.

The known headlight devices can, depending on the concrete design, for example the used features of variation of the light distribution, perform predetermined lighting functions, in particular low beam, high beam or fog beam. Each of these light functions has a predetermined characteristics, which partially is prescribed in accordance with the regulations. So, for example for low beam it is characteristic that the light outlet direction is inclined downwardly by approximately 1%, or in other words the greater intensity is offset on a screen arranged at a distance of 10 meters by 10 centimeters from the optical zero position. The relative inclination of 1% corresponds to an absolute inclination of approximately 0.55 angular degrees. Moreover, the low beam has an asymmetrical distribution, or in other words, during right traffic the region of the bright-dark limit is at the right from the optical zero position by 15 angular degrees, so that the right roadway edge is illuminated better without blinding the countertraffic. For high beam it is for example characteristic that the light outlet direction extends substantially horizontally, or in other words the high beam has its greatest intensity around the optical zero position. Furthermore, the high beam has a symmetrical light distribution, or in other words no 15% increase and no sharp bright-dark limit, or in other words no screen device or a screen device spaced from the path of rays. For fog beam, it is finally a characteristic that the light outlet direction is inclined by approximately 2% downwardly, or in other words the greatest intensity on a screen arranged at a distance of 10 meters is offset by 20 centimeters from the optical zero position downwardly. A relative inclination of 2% corresponds to an absolute inclination of approximately 1.14 angular degrees. Moreover, the low beam has a symmetric light distribution, or in other words no 15% increase. Furthermore, the fog beam typically has a lower light current than the low beam or the high beam and is arranged as deep as possible on a roadway, to reduce blinding of the driver. Finally, the fog beam illuminates the region in front of the vehicle substantially wider than the low beam or the high beam.

Because of the different characteristics of different light functions, in the prior art, in particular in headlight devices of the modern construction with gas discharge lamps, it is conventional to provide for each light function a special headlight device, which is oriented to the corresponding light functions. From the prior art (for example German patent document DE 44 07 108 A1) two headlight devices are known, which can perform the functions of the low beam and high beam. Because of a great difference in the characteristics for the low beam or high beam and fog beam, in the prior art no headlight devices known which can perform the functions of both a low beam or a high beam and also a fog beam.

SUMMARY OF THE INVENTION

Accordingly, it is an object of the present invention to provide a headlight device of the above mentioned general type which is improved and designed so that in addition to a low beam function and/or a high beam function, it can also perform a fog beam function.

In keeping with these objects and with others which will become apparent hereinafter, one feature of present invention resides, briefly stated, in a headlight device which has a dispersing element bringable in a path of the light beams reflected by the reflector.

For obtaining the light distribution characteristic for the fog light in the region in front of the vehicle, the inventive headlight device has a dispersing element which is bringable in the path of the light beams reflected by the reflector. The dispersing element must not necessarily be movable itself in order to be brought in the inventive manner into the path of the reflected light beams. It is also possible that the beam path is deviated so wide that the light beams strike on the dispersing element. It is decisive that in accordance with the present invention the headlight arrangement has the dispersing element which in the low beam operation or high beam operation of the headlight device is located outside of the post beam path, and is bringable into the beam path for the fog beam operation in any manner.

The inventive headlight device can, in addition to a low beam, and/or high beam function, perform a fog light function. Thereby an additional reflector and a complete light source-parts set (for gas discharge lamps for example a preswitching device, an ignition device, a lamp plug, a lamp, a cable, etc.) for a separate fog headlight device are dispensed with. A special advantage of the inventive headlight device is that the low beam or the high beam is turned off positively with activated fog beam function, since the light beams of the light source are used for the fog functions. Thereby the blinding of the driver is significantly reduced.

In accordance with a preferable embodiment of the invention, it is proposed the light source and the reflector of the headlight device are turnable about a first turning axis so that the light beams reflected by the reflector impinge on a prism and a dispersing element arranged after the prism. In this embodiment the light source together with the reflector are turned so far out of the position for the low beam and high beam, that the reflected light beams impinge on the prism and then on the dispersing element. The dispersing element is therefore brought in the beam path of the light beams reflected by the reflector so that the beam path is deviated to the dispersing element.

The prism serves for compensating an optical offset of the light beams due to the deviation of the light beams on the prism and the dispersing disk and for deviating the light beams on the dispersing disks so that they leave the dispersing disk as fog light with the known characteristics.The prism can be assembled of a plurality of individual prism segments. Instead of the prism, also another optical component can be utilized which is formed so as to compensate the optical offset of the light beams.

This embodiment has the advantage that no additional adjusting element for displacement of the dispersing element is needed. In order to bring the dispersing element in the beam path of the reflected light beams, simply the reflector with the light source is turned. For this purpose an adjusting motor which is already provided in many vehicles for a light width regulation can be utilized. Its displacement region is correspondingly expanded so as to deviate the beam path of the light beams reflected by the reflector so wide that it impinges on the prism.

It is recommended that the first turning axis extends vertically and perpendicular to the light outlet direction, and the reflector is turnable with the light source laterally, so that the light beams impinge on the prism. Preferably, the first turning axis extends however also substantially horizontally perpendicular to the light outlet direction. For turning the reflector with the light source about the first turning axis which extends in this way, the adjusting motor of a light width regulation with widened adjustment region can be utilized. The prism and the dispersing element can be arranged for example under the light source and the reflector. With a fog light which extends as deep as possible from the vehicle, the blending of the driver of the vehicle can be reduced since the fog light illuminates under the fog and not in the fog and reflected in the vision field of the driver.

In accordance with the preferable embodiment of the invention, the prism is turnable about a second turning axis. By turning the prims about the second turning axis, the inclination of the light outlet direction of the fog light can be adjusted in accordance with the regulations. The adjusted inclination, depending on the mounting height of the headlight device in front of the vehicle can be varied. The prism can be fixed in the adjusted inclined position. It is recommended that the inclination of the prism about the second turning axis be adjusted depending on the inclination of the chassis of the vehicle in the longitudinal axis relative to the upper surface of the roadway, for example because of non uniform loading or driving over roadway unevenness. The adjustment of the inclination of the prism is performed for example by a control or a regulation. Also, the second turning axis can extend preferably in a substantially horizontal direction and perpendicular to the light outlet direction.

In accordance with another preferable embodiment of the invention, it is proposed that the reflector and the light source of the headlight device are turnable about the first turning axis downwardly, and the control element is turnable in the beam path of the light beams reflected by the reflector. In this embodiment the dispersing element is turnable in the beam path of the reflected light beams. By the turning of the light source about the first turning axis downwardly, the light outlet direction can be inclined up to 2% downwardly, so that the greatest intensity of the light distribution on a screen arranged at the distance of 10 meters is offset downwardly by 20 centimeters from the optical zero position. The control element which is bringable in the beam path for the fog light function of the headlight device produces together with the inclination of the reflector with the light source by 2%, a light distribution in the region in front of the vehicle which is characteristic for the fog light. This embodiment has the advantage that it has an especially small size.

The displacing element in the advantageous feature of the present invention is formed as a dispersing disk. Preferably the dispersing element provides an increase of the side dispersion of the light beams reflected by the reflectors. The side dispersion of the light beams reflected by the reflector and passing through a dispersion of the region in front of the vehicle amounts preferably to +/−80 angular degrees.

In accordance with another preferable embodiment of the present invention it is proposed that the headlight device has a screen device adjustable between a position for the low beam and the position for the high beam for producing a bright-dark limit in the region in front of the vehicle. The screen device is arranged so in the headlight device that the light beams reflected by the reflector are deviated via the screen device in the region in front of the vehicle. For the low beam, the screen is arranged in the beam path of the light beams. The upper edge of the screen device is then formed as a bright-dark limit in the region in front of the vehicle. For the high beam, the screen device is spaced from the beam path of the reflected light beams. In the region in front of the vehicle, no sharp bright-dark limit is formed any longer, and the light beams have a great width.

Preferably, the screen device is at least partially turnable from the beam path of the light beams reflected by the reflector. The screen device has for example partial regions, by which the 15% increase in the bright-dark limit of the low beam is produced. These partial regions can be formed turnably out of the beam path. Thereby for the vehicle which is designed for the right traffic, 15% increase of the bright-dark limit can be lowered in the horizontal plane, whereby during left driving a blinding of the opposite traffic is presented. This partial lowering of the 15% increase of the bright-dark limit is identified also a tourist solution. For the fog light function of the headlight device, the 15% increase of the bright-dark limit can be also lowered. A headlight device formed in this manner can emit both low beam and high beam and additionally fog beam. For three light functions, however a single headlight device with a light source, a reflector and a light source-parts set is needed. Such a headlight device can be formed with especially small size and low cost.

In accordance with another advantageous embodiment of the present invention it is proposed that the headlight device has a lense device. It bundles the light beams reflected by the reflector on to the region in front of the vehicle.

In accordance with a further preferable embodiment, the reflector is formed as a poly-elipsoid element. Headlight devices with such a reflector are identified as poly-ellipsoidal systems (PES). PES usually is connected with a tourist solution which provides a partial lowering of the screening device. The tourist solution of this headlight can be derived from a fog light for producing the characteristic light distribution. No additional components are needed for lowering the 15% increase of the bright-dark limit.

The headlight device furthermore preferably has a means for adjusting the light beams. These means are for example formed as an adjusting motor and a control device for controlling the adjusting motor. With these means, the inclination of the headlight device or the reflector, the light source and in some cases the screen device from the position for the low beam or from the position for high beam is possible about a first turning axis which extends horizontally, by up to 2% downwardly. Therefore the greatest intensity of the fog beam on a screen located at a distance of 10 meters is offset downwardly by 20 centimeters from the optical zero position. Additional components for lowering the light outlet direction can be dispensed with.

Preferably the light source is formed as a gas discharge lamp, preferably as a xenon lamp. The advantages of the inventive headlight device are pronounced in particular in the headlight devices with a gas discharge lamp as a light source.

For further reduction of blinding by the inventive headlight device in the fog light operation, it is proposed that with the control element arranged in the beam path of the light beams reflected by the reflector, the light current of the light source is reduced.

Two advantageous embodiments of the present invention are illustrated in the drawings.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
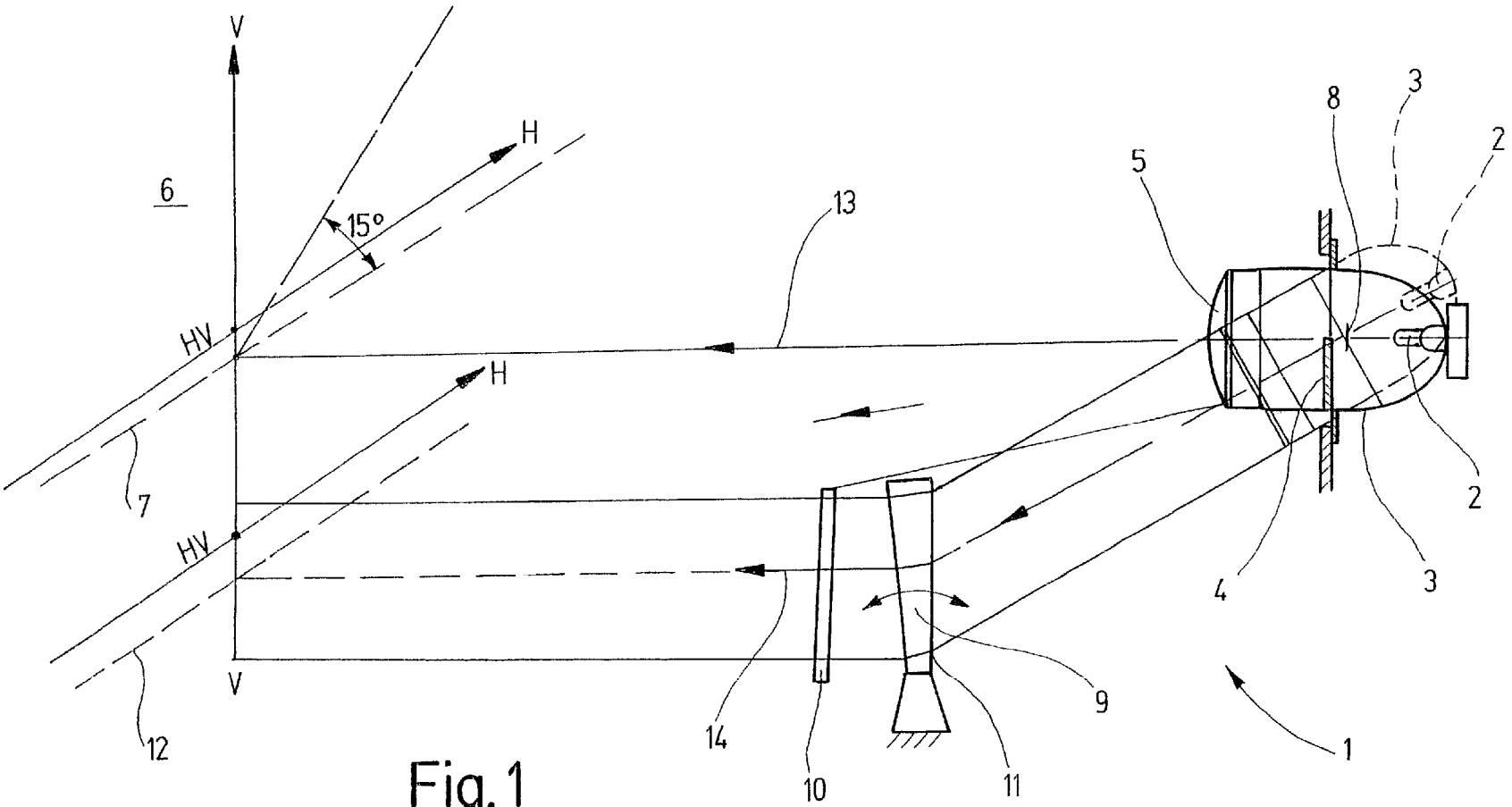
FIG. 1 is a view showing a headlight device in accordance with the first embodiment of the present invention.

A headlight device in accordance with the present invention is identified as a whole with reference numeral 1. The headlight device 1 is arranged on a vehicle, in particular on a motor vehicle and serves for illumination of a region in front of the vehicle. The headlight device 1 has a light source 2 for emitting light beams and a reflector 3 for reflecting at least a part of the light beams emitted by the light source 2 in a light outlet direction onto a region in front of the vehicle. The headlight device 1 also has a screen device 4, over which the reflected light beams are emitted by the reflector 3. Finally, the headlight device 1 has a lens device 5 which bundles the light beams reflected by the reflector 3 onto the region in front of the vehicle. The reflector 3 of the headlight device has a poly-ellipsoid shape.

A screen 6 is arranged at a distance of approximately 10 meters from the headlight device 1 and illustrates the light distribution of the headlight device 1. A vertical axis V and a horizontal axis H of the light distribution are shown on the screen 6. The intersecting point of the vertical axis V and the horizontal axis H is an optical zero position HV.

The headlight device is shown in FIG. 1 in a position for low beam with a solid line. In the position for low beam the light distribution for the headlight device 1 has a sharp bright-dark limit 7 which is located substantially 1% under the horizontal axis H. In other words the greatest intensity of the light distribution on the screen 6 is offset downwardly by approximately 10 cm from the optical zero position HV. The bright-dark limit 7 is produced by the upper edge of the screen device 4. The low beam has moreover an asymmetric light distribution. In other words, in the headlight device 1 designed for right traffic, the region of the bright-dark limit 7 is lifted right of the optical zero position HV by approximately 15 angular degrees, so that the right roadway edge is illuminated better without blinding the opposite traffic.

The headlight device 1 can be brought in a simple manner in a position for fog beam (represented by a broken line). For this purpose the reflector 3, the light source 2 and the lens device 5 are turned downwardly about a turning axis 8 which is horizontal and perpendicular to the light outlet direction 13, so that the light beams reflected by the reflector 3 impinge on a prism 9. The prism 9 serves for compensating an optical offset of the light beams due to deviation of the light beams. The light beams impinging on the prims 9 extend outwardly at the opposite side of the prism 9 onto a dispersion disk 10 arranged after the prism 9. Via the dispersion disk 10, the side dispersion of the light beams reflected by the reflector 3 is increased to a value of more than +/−80 angular degrees.

During the turning movement of the reflector 3, the light source 2 and the lens device 5 about the turning axis 8, the screen device 4 remains in its initial position. The turning axis 8 is arranged offset at a distance to the upper edge of the screen device 4 in direction of the apex of the reflector 3. The turning of the reflector 3 and the light source 2 causes a lifting of the upper edge of the screen device 4 relative to the reflector and the light source 2. This lifting of the upper edge of the screen device 4 causes a lowering of the bright-dark limit 12 of the light distribution for the fog lights. The upper edge of the screen device 4 is lifted so far that the light outlet direction 14 of the fog light is inclined downwardly by approximately 2%. In other words the greatest intensity on the screen is off set downwardly by approximately 20 cm from the optical zero position HV. Furthermore, with the light distribution for the fog light, the 15% increase is lowered on a horizontal course of the bright-dark limit 12. This can be provided for example in that the screen device 4 has a partial region, via which the 15% increase in the bright-dark limit 7 of the low beam light is produced. This partial region in the position for fog light is turned out of the beam path of the light beams.

The prism 9 is turnable about a second turning axis 18 which extends horizontally and perpendicularly to the light outlet direction 14. Thereby the light outlet direction 14 for fog light can be displaced in a vertical direction.

Figure 2:
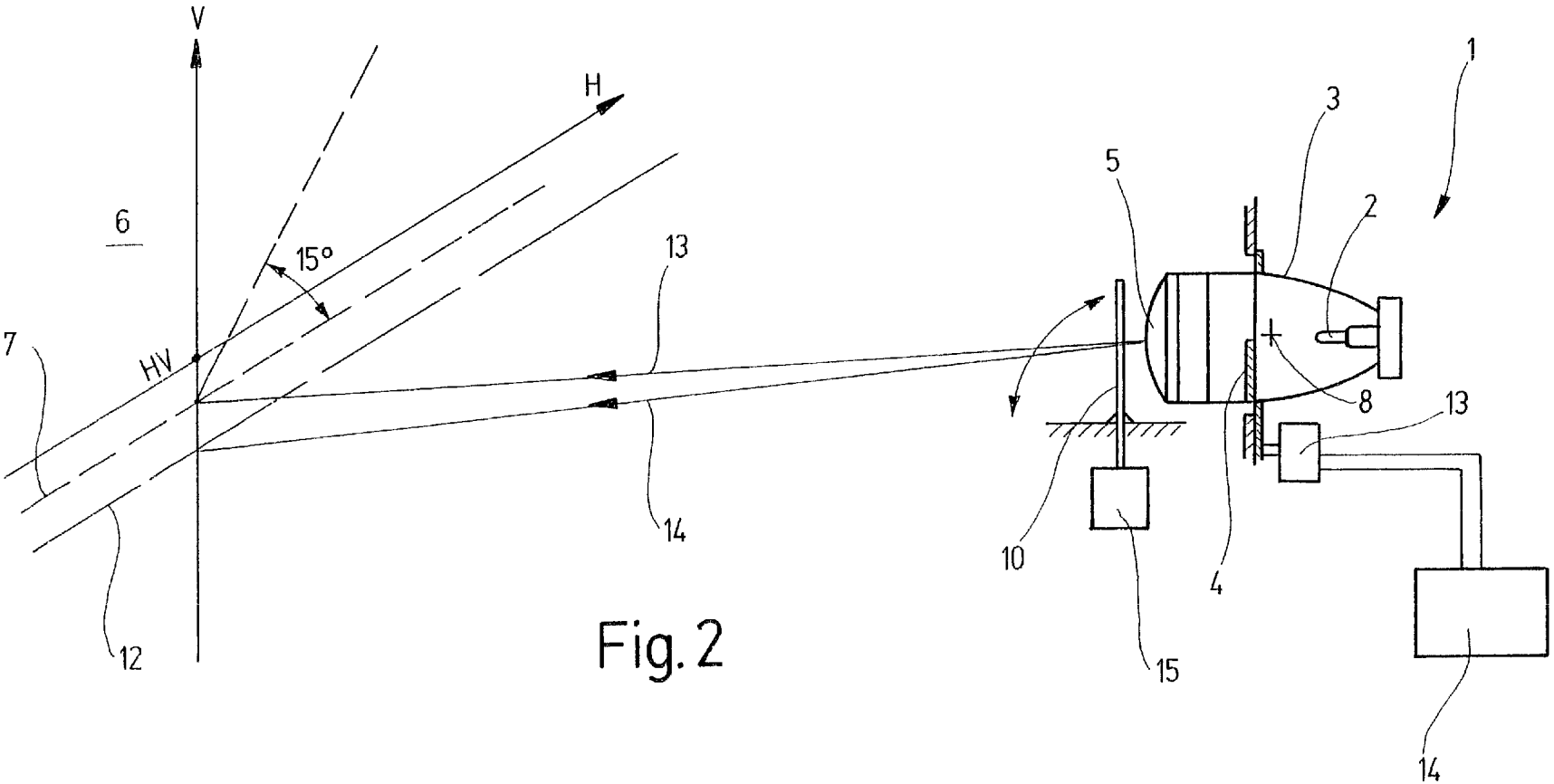
FIG. 2 is a view showing an inventive headlight device in accordance with a second embodiment of the present invention.

FIG. 2 shows a second embodiment of the inventive headlight device 1. In this embodiment the dispersion disk 10 is turnable in the beam path of the light beams reflected by the reflector 3. In FIG. 2 the dispersing disk 10 is shown in the position for fog light. The reflector 3, the light source 2 and the lens device 5 are turned downwardly for switching over from low beam to fog beam around the turning axis 8. With this turning movement, the upper edge of the screen device 4 is again lifted relative to the reflector 3 and the light source 2, which leads to a lowering of the bright-dark limit 12 of the fog light. By turning of the partial region of the screen device 4, by which the 15% increase in the bright-dark limit 7 of the low beam is produced, the 15% increase can be lowered to a horizontal course of the bright-dark limit.

The turning of the reflector 3 with the light source 2 about the turning axis 8 can be performed by a stepper motor 13 for a light width regulation. For this purpose the stepper motor 13 can be controlled by a control device 14 in a suitable manner. The headlight device 1 also has an adjusting element 15 for turning of the dispersion disk 10.

It will be understood that each of the elements described above, or two or more together, may also find a useful application in other types of constructions differing from the types described above.

While the invention has been illustrated and described as embodied in headlight device for vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims:

What is claimed is:

1. A headlight device for motor vehicles, comprising a light source for emitting light beams; a reflector for reflecting at least a part of the light beams emitted by said light source in a light outlet direction on a region in front of the vehicle; and a dispersing element which is bringable in and removable from a beam path of the light beams reflected by said reflector during operation of the headlight device so that the headlight device can emit both low beam and high beam and additionally fog beam so that in addition to a low beam function and/or a high beam function it can also perform a fog beam function.

2. A headlight device as defined in claim 1, wherein said dispersing element is formed as a dispersing disk.

3. A headlight device as defined in claim 1, wherein said dispersing element is formed so that it provides an increase of a side dispersion of the light beams reflected by said reflector.

4. A headlight device as defined in claim 3, wherein said dispersing element is formed so that said side dispersion of the light beams extending from said reflector through said dispersing element on the region in front of the vehicle amounts to over +/−80 angular degree.

5. A headlight device as defined in claim 1; and further comprising a screening device which is displaceable between a position for low beam and a position for high beam, for producing a bright-dark limit in the region in front of the vehicle.

6. A headlight device as defined in claim 5, wherein said screening device is turnable at least partially from the beam path of the light beams reflected by said reflector.

7. A headlight device as defined in claim 1; and further comprising a lens device which bundles the light beams reflected by said reflector on the region in front of the vehicle.

8. A headlight device as defined in claim 1, wherein said reflector has a poly-ellipsoid shape.

9. A headlight device as defined in claim 1; and further comprising means for adjusting a light width.

10. A headlight device as defined in claim 1, wherein said light source is a gas discharge lamp.

11. A headlight device as defined in claim 1, wherein said light source is a xenon lamp.

12. A headlight device as defined in claim 1, wherein said dispersing element is arranged in the beam path of the light beams reflected by said reflector to reduce a light current of said light source.

13. A headlight device for motor vehicles, comprising a light source for emitting light beams; a reflector for reflecting at least a part of the light beams emitted by said light source in a light outlet direction on a region in front of the vehicle; a dispersing element which is bringable in a beam path of the light beams reflected by said reflector; and a prism located so that said dispersing element is arranged after said prism, at least said reflector and said light source being turnable about a first turning axis so that the light beams reflected by said reflector impinge on said prism and on said dispersing element arranged after said prism.

14. A headlight device as defined in claim 13, wherein said first turning axis extends substantially horizontally and perpendicular to said light outlet direction.

15. A headlight device as defined in claim 13, wherein said prism and said dispersing element are arranged under said light source and said reflector.

16. A headlight device as defined in claim 13, wherein said prism is turnable about a second turning axis.

17. A headlight device as defined in claim 16, wherein said second turning axis extends substantially perpendicular to said light outlet direction.

18. A headlight device for motor vehicles, comprising a light source for emitting light beams; a reflector for reflecting at least a part of the light beams emitted by said light source in a light outlet direction on a region in front of the vehicle; a dispersing element which is bringable in a beam path of the light beams reflected by said reflector, wherein at least said reflector and said light source are turnable downwardly about a first turning axis, and said dispersing element is turnable into a beam path of said light beams reflected by said reflector.

* * * * *